US006896747B2

(12) United States Patent
Hauser et al.

(10) Patent No.: US 6,896,747 B2
(45) Date of Patent: May 24, 2005

(54) AUSTENITIC ALLOY FOR HEAT STRENGTH WITH IMPROVED POURING AND MANUFACTURING, PROCESS FOR MANUFACTURING BILLETS AND WIRE

(75) Inventors: Jean-Michel Hauser, Ugine (FR); Christophe Bourgin, Albertville (FR)

(73) Assignee: Usinor, Puteaux (FR)

( * ) Notice: Subject to any disclaimer, the term of this patent is extended or adjusted under 35 U.S.C. 154(b) by 122 days.

(21) Appl. No.: 10/285,424

(22) Filed: Nov. 1, 2002

(65) Prior Publication Data

US 2003/0103859 A1 Jun. 5, 2003

(30) Foreign Application Priority Data

Nov. 16, 2001 (FR) ..... 01 14818

(51) Int. Cl.[7] ..... C22C 38/50; C21D 8/02; C21D 8/06

(52) U.S. Cl. ..... 148/327; 148/541; 148/542; 148/547; 148/653; 148/598; 148/609; 148/597; 420/47; 420/48

(58) Field of Search ..... 148/327, 597, 148/598, 609, 541, 542, 547, 653, 325; 420/47, 48, 584.1, 586.1

(56) References Cited

U.S. PATENT DOCUMENTS

| | | | |
|---|---|---|---|
| 3,065,067 | A | 11/1962 | George |
| 3,065,068 | A | 11/1962 | Reynolds et al. |
| 3,169,858 | A | 2/1965 | Raymond |
| 3,201,233 | A | 8/1965 | Hull |
| 3,795,552 | A | 3/1974 | Barbis et al. |
| 5,945,067 | A | 8/1999 | Hibner et al. |

FOREIGN PATENT DOCUMENTS

| | | |
|---|---|---|
| EP | 0 669 405 | 8/1995 |
| FR | 2727982 | 6/1996 |

OTHER PUBLICATIONS

Patent Abstracts of Japan, vol. 013, No. 208, May 16, 1989.
Patent Abstracts of Japan, vol. 009, No. 153, Jun. 27, 1985.

*Primary Examiner*—Deborah Yee
(74) *Attorney, Agent, or Firm*—Sughrue Mion, PLLC

(57) ABSTRACT

Austenitic alloy for high-temperature strength with improved pourability and manufacturing, of which the composition comprises, in weight-%:

0.010%<carbon<0.04%
0%<nitrogen<0.01%
silicon<2%
16%<nickel<19.9%
manganese<8%
18.1%<chromium<21%
1.8%<titanium<3%
molybdenum<3%
copper<3%
aluminum<1.5%
boron<0.01%
vanadium<2%
sulfur<0.2%
phosphorous<0.04% and possibly up to 0.5% of at least one element chosen from among yttrium, cerium, lanthanum and other rare earths, the remainder being iron and impurities resulting from manufacturing or deoxidizing, the said composition also satisfying the two following relationships:

in relationship to the solidification mode:

remainder $a$=eq. $Ni_a$−0.5×eq. $Cr_a$<3.60 where eq. $Cr_a$=Cr+0.7×Si+0.2×Mn+1.37×Mo+3×Ti+6×Al+4×V, and where eq. $Ni_a$=Ni+22×C+0.5×Cu, in relationship to the rate of residual ferrite:

remainder $b$=eq. $Ni_b$−2×eq. $Cr_b$>−41 where eq. $Cr_b$=Cr+0.7×Si+1.37×Mo+3×Ti+6×Al+4×V, and where eq. $Ni_b$=Ni+22×C+0.5×Cu+0.5×Mn.

12 Claims, 4 Drawing Sheets ferritic axis austenitic dendrite final solidification phases

AUSTENITIC ALLOY FOR HEAT STRENGTH WITH IMPROVED POURING AND MANUFACTURING, PROCESS FOR MANUFACTURING BILLETS AND WIRE

The present invention concerns an austenitic alloy for heat strength with improved pourability and manufacturing. The present specification incorporates by reference the complete disclosure of 01 14818 filed Nov. 16, 2001.

BACKGROUND OF THE INVENTION

Steels for high-temperature mechanical strength include martensitic steels that can be used to around 550° C., non-oxidizing austenitic steels containing a hardening intermetallic phase precipitation, which can be used to around 650° C. Alloys of nickel or cobalt are also used, generally hardened by intermetallic precipitation.

Non-oxidizing austenitic steels for high-temperature mechanical strength, such as the steel with reference no. 1.4980, according to European standard EN 10269, also referenced as AlSi 660 according to the standard ASTM A453, are frequently used in bolt and screw manufacturing and forged parts, in particular in fasteners for automotive exhaust elements, such as turbocompressors or exhaust pipes. They are also found, in the form of drawn wires, in mesh for mechanical trapping in exhaust gas catalytic converters. Applications for these steels are also known in the area of springs that can be used at high temperature or exhaust hoses made up, on one hand, of rolled tubes—welded then crimped, and on the other hand, of metal wire mesh sheathing.

The composition of the steel AlSi 660 has a moderated chromium content, on the order of 15%, about 1% molybdenum, 0.3% vanadium. The austenitic character, necessary for high-temperature strength, is insured by a massive addition of nickel, i.e., on the order of 24%.

The hardening and the resistance to creep are insured by an addition of around 2% titanium, which is combined between 600° C. and 750° C. with one part nickel to form intermetallics of the type $Ni_3Ti$. The steel composition can also contain elements such as Mo, V, Al which also contribute to hardening and high-temperature strength by substituting atoms of titanium in the $Ni_3Ti$ compound.

The disadvantages of this steel are, in particular:

increased costs, particularly due to the significant nickel content, difficulty in manufacturing since, at the time of pouring, there are segregation formations which, unless specific precautions are taken, cause cracks in continuous pouring or at the time of hot rolling; as a result, it is necessary to use a costly manufacturing process involving remelting with grinding of the semi-finished products and increased inspections of the finished products.

To reduce the segregations, the silicon must be limited to a content of less than 0.3%, carbon to a content less than 0.050%, copper to a content lower than 0.5%, sulfur to a content less than 0.002%, phosphorous to a content less than 0.025%, lead to a content less than 0.0005%, etc. These limitations represent the additional costs of manufacturing at the steel plant.

difficulty in rolling since the segregations greatly lower the burning point. Because of this, rolling must not be carried out above around 1150° C. in order to avoid the formation of serious defects, e.g. hot cracks. Taking into account the increased yield stress of the alloy below this temperature, the rolling cannot be carried out except on certain particularly robust systems. In addition, the rolling speed must be reduced in order to avoid any reheating above the burning point.

a limitation in the resistance to oxidizing and corrosion at high temperature because of the low amounts of chromium and silicon, under particularly intense exposure conditions, e.g. in exhaust lines.

difficulty in machining parts, particularly because of the small amount of sulfur.

difficulty in welding, especially in the case of AlSi 660 sheet metal welded to itself, with or without a supply of wire of the same alloy, since a great tendency to fissuring at high temperature is observed.

In the family of austenitic steels for high-temperature mechanical strength, hardened by intermetallic nickel-titanium precipitation, the following are known:

the steel AlSi 660 referenced above, an IMPHY patent No. FR 94 14 942 that describes the following composition:

Ni: 16% to 25%; Cr: 16% to 18.5%; Ti: >1%; Mn: 0% to 2%.

a NIPPON KOKAN patent JP 62267453 describing the following composition: C<0.01%; Ni: 10% to 18%; Cr: 13% to 20%; Ti: >1.5%; Mn: 0% to 2%.

Theoretical knowledge of the phases present at the time of solidification or in solid phase, in the quaternary alloys Fe—Cr—Ni—Ti remains incomplete. This was published by V. RAGHAVAN in 1996 in "Phase diagrams of quaternary iron alloys," ed. The Indian Institute of Metals, pages 374 to 380. The range analyzed does not extend to compounds containing more than 1.7% Ti.

We have noted that the main difficulties encountered with the steel AlSi 660 result from its solidification mode, which proves to be direct solidification in austenitic form, in contrast to the majority of non-oxidizing austenitic steels, which solidify in ferrite, which then transforms to austenite at lower temperature.

The alloy according to the IMPHY patent, with limited chromium content, has austenitic solidification, as we will demonstrate in the following. Thus it is subject to the problems in pouring and rolling that are connected with segregations.

The composition of the alloy according to the NIPPON KOKAN patent shows a low amount of nickel mixed with a chromium content between 13% and 20%. The nickel content expresses itself inadequately to insure hardening and an effective creep resistance at 650° C. and above. In addition, the very small amount of carbon, less than 0.010% makes it unsuitable for manufacturing in air. In all cases, it probably does not solidify to ferrite.

BRIEF SUMMARY OF THE INVENTION

The goal of the invention is to propose an alloy of the non-oxidizing austenitic type for high-temperature mechanical strength, which can be manufactured in an economical manner and is particularly adapted to continuous pouring and to manufacturing at high temperature.

The object of the invention is an austenitic alloy for high-temperature strength with improved pourability and manufacturing, of which the composition is, in weight-%:

0.010%<carbon<0.04%

0%<nitrogen<0.01% silicon<2%

16%<nickel<19.9% manganese<8%

18.1%<chromium<21%

1.8%<titanium<3% molybdenum<3% copper<3% aluminum<1.5% boron<0.01% vanadium<2% sulfur<0.2% phosphorous<0.04% and possibly up to 0.5% of at least one element chosen from among yttrium, cerium, lanthanum and other rare earths, the remainder being iron and impurities resulting from manufacturing or deoxidizing, the said composition also satisfying the two following relationships:

in relationship to the solidification mode:

remainder $a$=*eq.* $Ni_a$−0.5×eq. $Cr_a$<3.60 where eq. $Cr_a$=Cr+0.7×Si+0.2×Mn+1.37×Mo+3×Ti+6×Al+4×V, and where eq. $Ni_a$=Ni+22×C+0.5×Cu, in relationship to the rate of residual ferrite:

remainder $b$=*eq.* $Ni_b$−2×eq. $Cr_b$>−41 where eq. $Cr_b$=Cr+0.7×Si+1.37×Mo+3×Ti+6×Al+4×V, and where eq. $Ni_b$=Ni+22×C+0.5×Cu+0.5×Mn.

In the preferred embodiments, the invention may contain the following characteristics, taken alone or in combination:

the amount of chromium is greater than 18.5%, the amount of manganese is greater than 2%, the amount of silicon is greater than 1%, the amount of nickel is greater than 18%, the amount of aluminum is greater than 0.3%, the amount of sulfur is greater than 0.030%, the composition satisfies the following relationship, all amounts in mass-%:

in relationship to the absence of formation of the embrittling sigma phase:

value $c$=Cr+1.5×Si+1.5×V+1.2Mo<22.

A second object of the invention is comprised of a manufacturing process for a billet of alloy of a composition conforming to the invention and which includes the steps consisting of:

a) manufacturing the composition in air with electric furnace,
b) refining in A.O.D. converter,
c) continuous pouring in the form of blooms,
d) rolling the said blooms into billets at high temperature after reheating to between 1100 and 1200° C.

A third object of the invention is made up by a fabrication process for alloy wire with composition conforming to the invention and which includes the steps consisting of:

e) hot rolling after reheating, to between 1100 and 1200° C., of the billets obtained by the process for manufacturing billets according to the invention, to obtain the wire rod,
f) annealing the said wire rod,
g) pickling it,
h) drawing or stretching it.

A fourth object of the invention is made up of a manufacturing process for bars of an alloy with composition conforming to the invention and which includes the steps consisting of:

e) hot rolling, after reheating to between 1100 and 1200° C., of the billets obtained by the manufacturing process for billets according to the invention, to obtain bars
f) and annealing the said bars.

A fifth object of the invention is made up by alloy parts that can be obtained by machining or forming at low temperature or high temperature, or processing, a wire or a bar obtained using one of the procedures according to the invention, starting with a billet.

The description that follows and the figures attached, presented in a non-limiting manner, will make the invention easy to understand.

DETAILED DESCRIPTION OF THE INVENTION

Figure 1A:
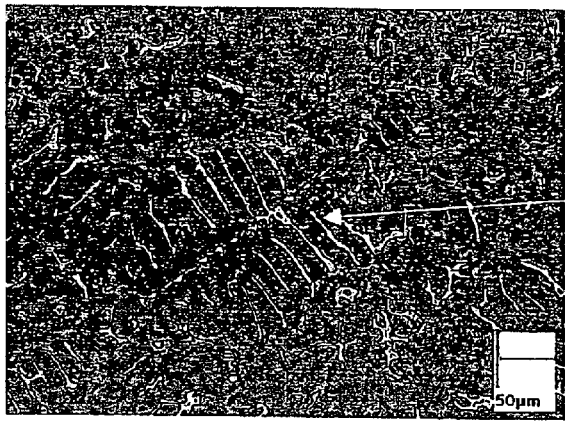
FIG. 1*a* is a micrograph in a state of rough solidification showing the phases formed at the start of solidification with the presence of ferrite with dendrite axis.
Figure 1B:
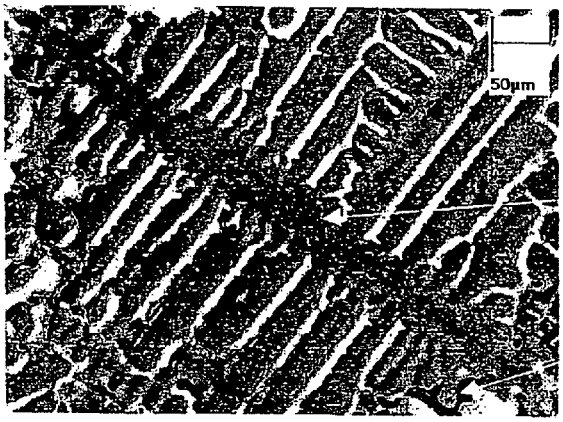
FIG. 1*b* is a micrograph in a state of rough solidification showing the phases formed at the start of solidification with the presence of dendrites with austenitic axis in a prior art steel.

FIGS. 1*a* and 1*b* are micrographs in a state of rough solidification showing the phases formed at the start of solidification with, on one hand in FIG. 1*a*, in an example of invention 13605, the presence of ferrite with dendrite axis, clearly on the figure, and on the other hand in FIG. 1*b* that corresponds to a counter-example the presence of dendrites with austenitic axis in the IMPHY steel of the prior art.

Figure 2:
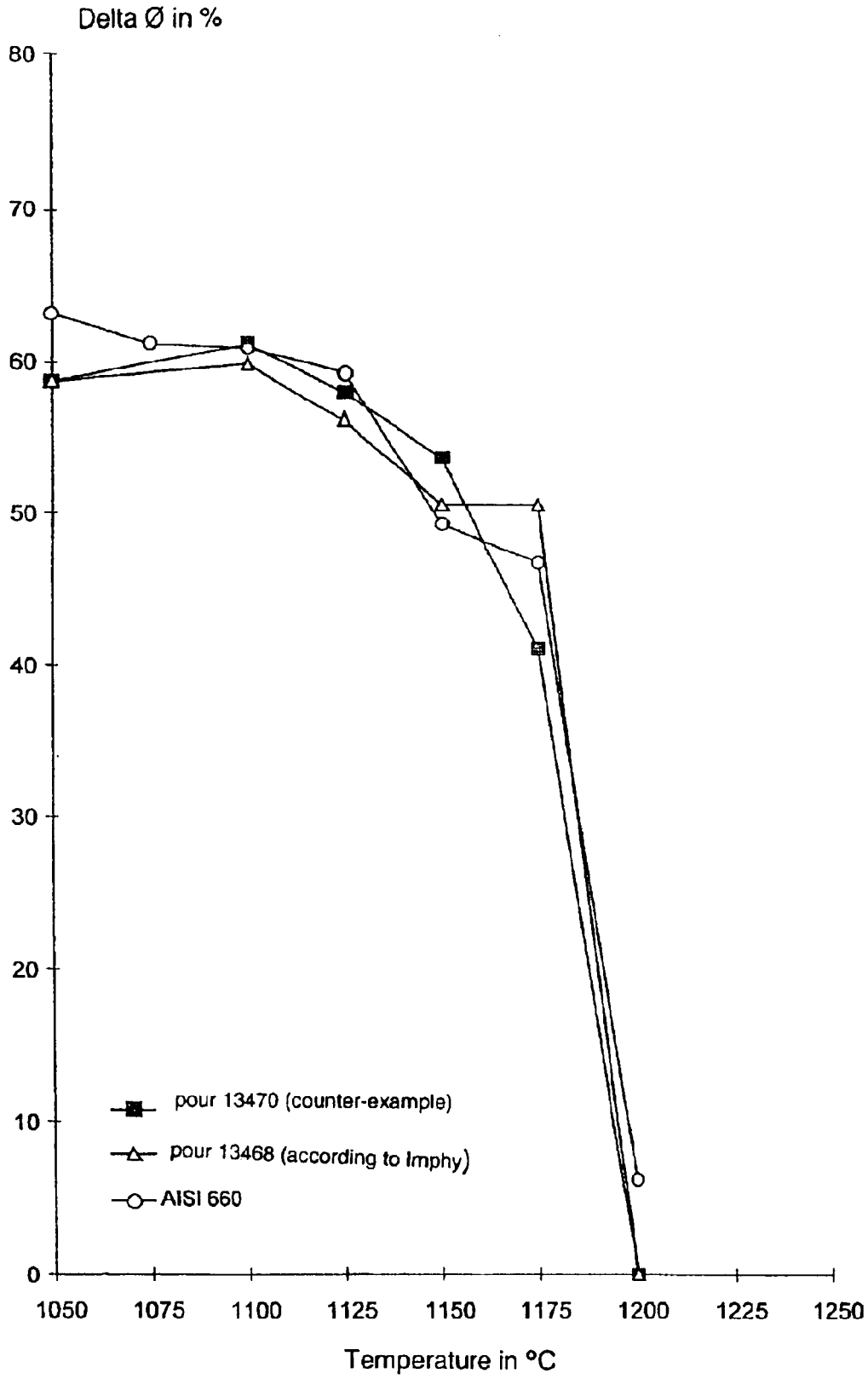
FIGS. 2–4 show the high-temperature ductility curves of the compositions in Table 1 (the burning points are estimated by the temperature at which the ductility is maximum given in Table 2).
Figure 3:
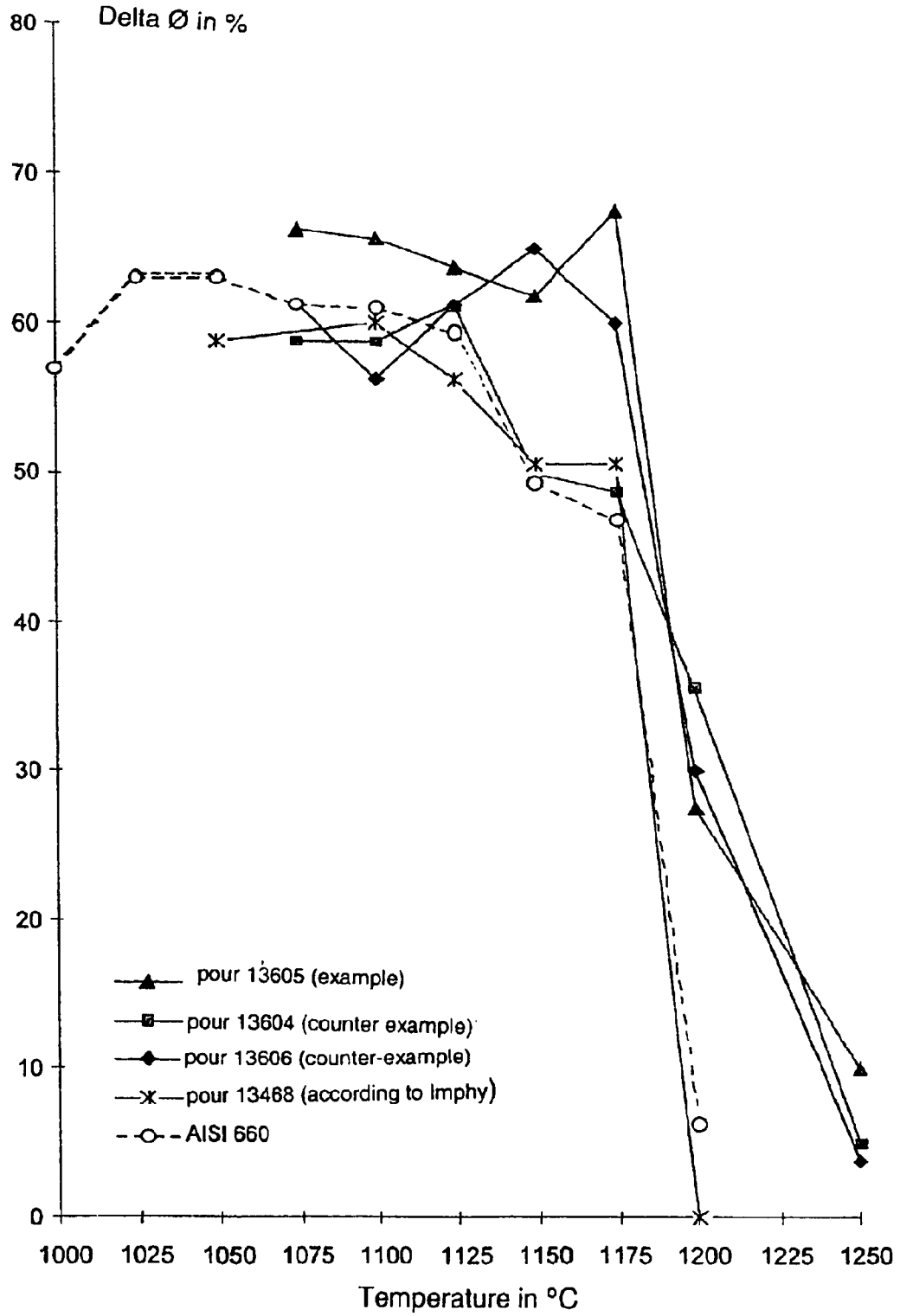
Figure 4:
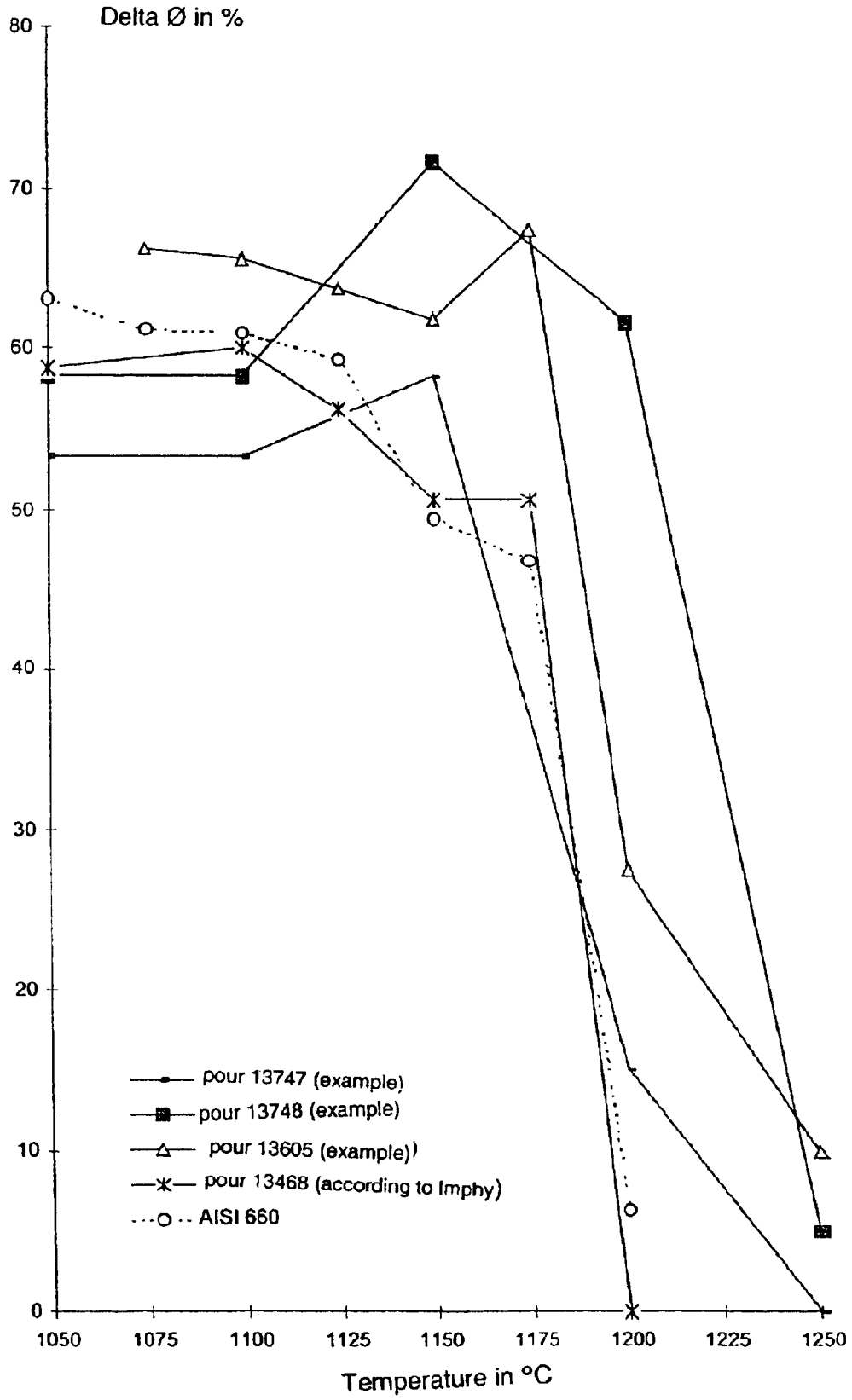

FIGS. 2, 3 and 4 show the high-temperature ductility curves of the compositions in table 1; the burning points, estimated by the temperature at which the ductility is maximum, are given in Table 2. The invention presented concerns an austenitic alloy for high-temperature strength with improved pourability and manufacturing.

Following the studies carried out on pours, with determination of the solidification mode, the burning point, the phases present at equilibrium between 1060° C. and 1240° C., as well as at 720° C. and 600° C., the ductility in traction at high temperature, called "forgeability," the resilience at 20° C. and the resistance to creep at 650° C., the inventors have found a general composition with which the problems of steels and alloys presented in the prior art are resolved, in particular in the area of hardening, of resistance to creep, and most especially in the area of solidification, insuring a ferritic solidification with a later transformation to solid phase of all of the ferrite into austenite.

According to the invention, a composition 1 corresponds to the following weighted composition:

Composition 1:

0.010%<carbon<0.04%

0%<nitrogen<0.01% silicon<2%

16%<nickel<19.9% manganese<8%

18.1%<chromium<21%

1.8%<titanium<3% molybdenum<3% copper<3% aluminum<1.5% boron<0.01% vanadium<2% sulfur<0.2% phosphorous<0.04% and possibly up to 0.5% of at least one element chosen from among yttrium, cerium, lanthanum and other rare earths, the remainder being iron and impurities resulting from manufacturing or deoxidizing, the said composition also satisfying the two following relationships:

in relationship to the solidification mode:

$$\text{remainder } a = eq.\ Ni_a - 0.5 \times eq.\ Cr_a < 3.60 \text{ where eq. } Cr_a = Cr + 0.7 \times Si + 0.2 \times Mn + 1.37 \times Mo + 3 \times Ti + 6 \times Al + 4 \times V, \text{ and where eq. } Ni_a = 22 \times C + 0.5 \times Cu,$$

in relationship to the rate of residual ferrite:

$$\text{remainder } b = eq.\ Ni_b - 2 \times eq.\ Cr_b > -41 \text{ where eq. } Cr_b = Cr + 0.7 \times Si + 1.37 \times Mo + 3 \times Ti + 6 \times Al + 4 \times V, \text{ and where eq. } Ni_b = Ni + 22 \times C + 0.5 \times Cu + 0.5 \times Mn$$

Composition 1 may also satisfy the following relationship:

in relationship to the absence of formation of the embrittling sigma phase:

$$\text{value } c = Cr + 1.5 \times Si + 1.5 \times V + 1.2Mo < 22.$$

the hardening and the creep resistance are insured by the intermetallic precipitates with $Ni_3Ti$ basis, obtained at the time of aging treatments at around 700–750° C., the quantities of Ti and Ni are adequate to insure this hardening precipitation, the amount of nickel is definitely less than 24%, the solidification mode is ferritic, surprisingly for this type of alloy, with later transformation into solid phase of almost all of the ferrite into austenite, the burning point, the temperature beyond which there is a loss in ductility in traction due to the start of local fusion is, in a favorable manner, greater than 1100° C. and preferably greater than 1150° C., the weighted amount, value c, of sigmagenic elements Cr, V, Mo, Si is low enough to avoid the precipitation of the sigma phase and embrittlement at the time of use between 600 and 750° C., the combinations of forming elements for austenite or ferrite are defined by the equivalents $eqNi_a$ and $eqCr_a$ as regards the solidification mode and $eqNi_b$ and $eqCr_b$ as regards residual ferrite after welding and annealing.

In addition, the composition satisfies the following relationships, all the elements in mass-%:

to insure the ferritic character of the solidification and an elevated burning point in relationship to the solidification mode:

$$\text{remainder } a = eq.\ Ni_a - 0.5 \times eq.\ Cr_a < 3.60 \text{ where eq. } Cr_a = Cr + 0.7 \times Si + 0.2 \times Mn + 1.37 \times Mo + 3 \times Ti + 6 \times Al + 4 \times V, \text{ and where eq. } Ni_a = Ni + 22 \times C + 0.5 \times Cu,$$

to limit, to trace amounts, the ferrite content after manufacturing at high temperature and annealing:

$$\text{remainder } b = eq.\ Ni_b - 2 \times eq.\ Cr_b > -41 \text{ where eq. } Cr_b = Cr + 0.7 \times Si + 1.37 \times Mo + 3 \times Ti + 6 \times Al + 4 \times V, \text{ and where eq. } Ni_b = Ni + 22 \times C + 0.5 \times Cu + 0.5 \times Mn$$

and possibly:

to insure the absence of embrittlement at the time of use between 600° C. and 750° C.:

$$Cr + 1.5 \times Si + 1.5 \times V + 1.2 \times Mo < 22$$

Preferably, to improve creep resistance: Ni>18% to improve resistance to oxidizing and the environment: Si>1% to improve oxidizing and creep resistance: Al>0.3% to improve machining capability: S>0.030%

In comparison with steels of the prior art mentioned, the following can be noted:

an improvement in the resistance to oxidizing and corrosion at high temperature, an improvement in machining capability the capability of welding the alloy according to the invention to itself in the scope of TIG or laser welding or as a supply material in the scope of MIG or TIG welding with wire supply, with suppression of the tendency to high-temperature fissuring.

In another preferred composition 2 according to the invention.

Composition 2:

0.010%<carbon<0.04% nitrogen<0.01%

0.01%<silicon<2%

16%<nickel<19.9%

2%<manganese<8%

18.1%<chromium<21%

1.8%<titanium<3%

0.01%<molybdenum<3%

0.01%<copper<3%

0.0005%<aluminum<1.5%

0.0001%<boron<0.01%

0.01%<vanadium<2%

0%<sulfur<0.2% phosphorous<0.04%, the rest being iron and other trace elements, residual elements or microadditions.

In addition, the composition satisfies the following relationships, with all the elements being in mass-%:

to insure the ferritic character of the solidification and the elevated burning point:

$$\text{remainder } a = eq.\ Ni_a - 0.5 \times eq.\ Cr_a < 3.60 \text{ where eq. } Cr_a = Cr + 0.7 \times Si + 0.2 \times Mn + 1.37 \times Mo + 3 \times Ti + 6 \times Al + 4 \times V, \text{ and where eq. } Ni_a = Ni + 22 \times C + 0.5 \times Cu,$$

to limit the amount of ferrite to traces after manufacturing at high temperature and annealing:

$$\text{remainder } b = eq.\ Ni_b - 2 \times eq.\ Cr_b > -41 \text{ where eq. } Cr_b = Cr + 0.7 \times Si + 1.37 \times Mo + 3 \times Ti + 6 \times Al + 4 \times V, \text{ and where eq. } Ni_b = Ni + 22 \times C + 0.5 \times Cu + 0.5 \times Mn$$

and possibly:

to insure the absence of embrittlement during use between 600 and 750° C.:

$$Cr+1.5\times Si+1.5\times V+1.2\times Mo<22.$$

Preferably:

to improve creep resistance: Ni>18% to improve resistance to oxidizing and the environment: Si>1% to improve oxidizing and creep resistance: Al>0.3% to improve machining capability: S>0.030%

In composition 2 of the invention, the manganese content is greater than 2%.

According to the invention, the relationships make it possible to select ferritic solidification compositions, without residual ferrite and do not form sigma phase.

Table 1 presents examples of pours carried out in a vacuum to achieve the alloy according to the invention, as well as counter-examples of pours that do not correspond to the invention and compositions according to the prior art cited.

The following in particular were studied:

a) on the ingot:

the solidification mode, by micrography, the ferrite quantity measured by magnetic method on the rough ingot and the ingot reheated 15 min. to 1240° C.

b) on the product finished by forging:

the quantities of residual ferrite, by magnetic measurements, after annealing 1 hour at 980° C. or 1060° C., the tensile ductility in high-temperature with an increase in the test temperature to a speed of 10° C./s, maintaining it for 80 s, a rapid traction at 14 s−1, measurement of the reduction in diameter. For a series of tests at increasing temperature, the temperature is evaluated starting from that of the ductility dropping rapidly, as a result of the start of local fusion. This temperature, called the burning point, must not by exceeded in reheating before rolling and during rolling, at the risk of creating defects.

c) on the product finished by forging, then annealed for one hour at a temperature of 980° C. or 1060° C., then aged for 16 hours at a temperature of 720° C.:

the presence of the sigma phase by micrography and, when there is any, of the quantity of the sigma phase by an X-ray diffraction method, the mechanical properties in traction, the strength and resistance at ambient temperature, resilience after additional aging of 200 h at 600° C., resistance to creep to break at 650° under 385 Mpa by measuring the time at break and elongation at break.

In the scope of solidification of the alloy, for the composition according to the invention, the solidification takes place in the form of ferritic dendritic axes, which contain the residual ferrite after cooling, as shown in FIG. 1*a*, in contrast to the known and observed cases of steel with reference AlSi 660 and the alloy according to the IMPHY patent, of which the solidification starts with the formation of austenite, as shown in FIG. 1*b*.

It has been possible to establish that, in the scope of the composition according to the invention, the criterion:

$$\text{remainder } a = eq.\ Ni_a - 0.5\times eq.\ Cr_a < 3.60 \text{ where eq. } Cr_a = Cr+0.7\times Si+0.2\times Mn+1.37\times Mo+3\times Ti+6\times Al+4\times V, \text{ and where eq. } Ni_a = Ni+22\times C+0.5\times Cu,$$

makes it possible to select the compositions with ferritic solidification.

The presence of more than 1% ferrite after reheating to 1240° C. also translates into the possibility of existence of this phase with equilibrium at high temperature, near the solidification point.

FIGS. 2, 3 and 4 show the high-temperature ductility curves for the compositions studied; the ductility is measured by delta Ø, which is the reduction in diameter at break, i.e., the relative variation in diameter at the level of the break; the burning points estimated using the temperature at which ductility is maximum are shown in Table 2.

It appears that the solidification in ferritic mode or starting with ferrite makes it possible to obtain the burning points greater than 1100° C., in contrast to solidification in austenitic mode.

Solidification in ferritic mode, obtained when the criterion above is complied with, makes it possible to reheat and roll the ingots or semi-finished products at normal speed between 1100 and 1200° C., preferably between 1120 and 1180° C., within a range of normal temperatures for non-oxidizing steels and compatible with the reheating furnaces and the mechanical dimensions of the rollers.

The residual ferrite measured in the product finished by forging from 1100° C. into an 18-mm octagonal bar and annealed 1 hour at 980° C. or 1060° C. is indicated in Table 2.

Certain compositions with ferritic solidification contain more than 1% ferrite. This residual ferrite should have a resistance to creep that is less than that of the austenitic phase. The criterion:

$$\text{remainder } b = eq.\ Ni_b - 2\times eq.\ Cr_b > -41 \text{ where eq. } Cr_b = Cr+0.7\times Si+1.37\times Mo+3\times Ti+6\times Al+4\times V, \text{ and where eq. } Ni_b = Ni+22\times C+0.5\times Cu+0.5\times Mn$$

makes it possible to select compositions with ferritic solidification that have less than 3% residual ferrite after process in the range 980° C.–1060° C., in such a way as to limit the loss of creep resistance.

After welding by forging, annealed at 980° C. or 1060° C. and 16 hours aging at 720° C., all the compositions were observed using optical metallography after electro-nitric attack. In addition to the residual ferrite, in certain compositions, the presence of an intermetallic phase is observed, which has been identified by X-ray diffraction as being the sigma phase. The quantitative measurements are indicated in Table 2.

The presence of the sigma phase is known to decrease the resilience and the strength of austenitic steels. A criterion has been determined that makes it possible to insure the absence of the sigma phase in the aged state:

$$Cr+1.5\times Si+1.5\times V+1.2\times Mo<22.$$

The criterion above thus makes it possible to insure a resilience level that is adequate in the processed state, as well as after usage at high temperature.

Table 2 indicates the traction characteristics and the strength measured at ambient temperature after forging, annealing of 1 hour at 980° C. or 1060° C. and aging for 16 hours at 720° C.

The elevated hardnesses are obtained for melts 13606 and 13604, due to the formation of the sigma phase.

The characteristics obtained for melts 13747, 13748 and 13605 are close to those of the cells of grade AlSi 660.

Pour 13470, with greater amounts of Ni and Ti, presents more improved characteristics.

The creep tests to break at 650° C. at 385 MPa have been carried out on the pours 13468 Imphy and 13605. The requirements usually set for mounting at high temperature, in particular greater than 100 hours at break, and greater than 5% extension at break are complied with.

According to the invention, a minimum carbon content of 0.010% is necessary to allow manufacturing "in air" in the systems such as electric furnace plus AOD refining and in the ladle without using vacuum or low pressure.

A maximum carbon content of 0.040% is necessary to avoid greatly lowering the liquidus of the alloy and increasing the solidification interval of the alloy, making continuous pouring impossible.

In addition, the carbon combines with part of the titanium in the form of TiC type carbides which is no longer available for strengthening the alloy in the form of $Ni_3Ti$ in the aged state. It is necessary to minimize this phenomenon by limiting the carbon content.

A maximum nitrogen content of 0.010% is the result of the reaction, in the liquid metal, of the titanium added in large quantity with the nitrogen that is already present: there is a formation and decantation of the TiN nitrides in the ladles and the pour distributors and the nitrogen content of the poured product must not exceed the preceding value.

Silicon is generally present in the composition, at least in trace amounts of which the level is 0.001% in the steel products.

Silicon contributes to the formation of ferrite and sigma phase. A maximum content of 2.0% is necessary to avoid accelerated formation of this latter embrittling phase.

The silicon contributes to improvement in resistance to oxidizing and the environment at high temperature, by forming more or less continuous layers of silica or silicates under the other oxides. A significant addition, e.g. of more than 1%, is thus useful when the solidification occurs in ferritic mode. A notable addition, e.g. between 0.2 and 2%, is possible without formation of significant segregations, as may be the case in certain solidification processes when the solidification occurs in austenitic mode.

A minimum manganese content of 0.001% is generally present as a residue deriving especially from the ferroalloys.

At the time of manufacturing, the manganese oxidizes easily during oxygen blasts intended to bring the carbon to the level required; a maximum content of 8% is necessary to permit refining under correct production conditions with the addition of manganese.

We have found that the manganese presents the specific feature of promoting the ferritic solidification mode, while promoting, in contrast, the suppression of the residual ferrite at the time of annealing between 900° C. and 1200° C., notably on the product manufactured at high temperature. It does not cause the formation of sigma phase.

Since it is necessary to obtain the ferritic solidification mode while avoiding an excess of other elements that form ferrite, such as Cr, Mo, Si, W, an excess which would cause embrittlement by forming the sigma phase at the time of aging, manganese proves to be especially useful when the goal is to greatly harden the alloy using a significant nickel content.

The addition of manganese causes an increase in the thickness of scales on products rolled at high temperature or annealed or at the time of use. A silicon addition, e.g. of more than 1%, then makes it possible to bring the oxidizing back to a normal level.

A minimum nickel content of 16%, in combination with titanium content greater than 1.8%, is necessary to obtain a significant hardening at the time of aging between 650° C. and 750° C. This hardening by precipitation of intermetallics, of the type $Ni_3Ti$, is necessary for the mechanical strength at ambient temperature of fastenings, as well as for their resistance to tension and creep at high temperature.

A maximum nickel content of 19.9% is imposed, particularly for economic reasons.

To improve the creep resistance, it is possible to add nickel above 18%. Under these conditions, the hardening that is produced at the time of aging at 720° C. practically reaches its maximum.

Taking into account the level of nickel necessary to harden the alloy, a minimum chromium content of 18.1% is necessary to balance the effect of austenite formation from the nickel and to obtain ferritic solidification, especially when the other elements that form ferrite, such as Si, Mo, Mn, Ti, Al, V are at a low level or close to their minimum amounts.

A maximum chromium content limited to 21% is necessary to avoid the formation of the embrittling sigma phase at the time of processing at 720° C. or use in the range between 600° C. and 700° C.

A minimum titanium content of 1.8% is necessary to obtain adequate hardening at the time of aging treatments or at the time of use in the range between 600° C. and 750° C. A fine precipitation with $Ni_3Ti$ basis then forms which contributes to the high-temperature mechanical strength, especially in creep conditions.

Titanium is also present in the alloy in the form of titanium nitride, titanium carbide and titanium phosphide.

A content limited to 3.0% is necessary to avoid lowering the liquidus and the formation, at the time of solidification, of large intermetallics that could impair drawing capability.

A minimum molybdenum content of 0.010% is generally present in traces at the time of industrial production.

The molybdenum contributes to the formation of ferrite at the time of solidification and to the formation of hardening intermetallics, by substituting titanium atoms. The addition of molybdenum makes possible an improvement in the high-temperature strength of the alloy, thus increasing the content of precipitates and the shearing resistance.

A maximum content of 3% is necessary to prevent the formation of the sigma phase in connection with the chromium, as well as the presence of residual ferrite.

A minimum copper content of 0.010% is generally present in the form of manufacturing residue.

The copper contributes to the formation of austenite and makes it possible to reduce the rate of residual ferrite, in the same way that nickel does.

A maximum content of 3% is imposed to prevent great segregations at the time of pouring and the formation of a phase that is rich in copper that greatly lowers the burning point.

A minimum content of 0.0005% aluminum is generally present in the form of manufacturing residue.

The addition of aluminum makes it possible to increase the content of hardening precipitates and the high-temperature strength by substituting titanium atoms.

In addition, the aluminum can be used to increase the ferritic character of the alloy at the time of solidification without having the disadvantage of generating the embrittling sigma phase when maintained at temperatures in the range between 550° C. and 700° C.

A maximum aluminum content of 1.5% is necessary to avoid exhaustion of the nickel at the time of intermetallic formation and the presence of residual ferrite.

A minimum boron content of 0.0001% is generally present in the form of trace amounts.

The presence of boron in amounts of 10 to 30 ppm, for example, allows a slight improvement in the high-temperature ductility in the temperature range between 800° C. and 1100° C.

A maximum content of 0.01% is necessary to prevent excessive lowering of the solidus and of the burning point that it causes.

A minimum vanadium content of 0.01% is generally present in the form of manufacturing residue.

The vanadium, the ferritizing element and former of the sigma phase, may be added to contribute to the hardening by substitution of the titanium atoms in the intermetallic compounds.

A maximum vanadium content of 2% is necessary to prevent the formation of the sigma phase, in combination with the chromium present.

A minimum sulfur content of 0.0001% is generally present as a refining residue.

The sulfur can be maintained deliberately, or added at preferably more than 0.030% to improve the machining capability of the alloy due to the presence of titanium sulfides and carbosulfides formed at the time of solidification which improve the fragmentation of chips. This addition is made possible by the ferritic solidification mode, since the addition of sulfur does not greatly decrease the high-temperature ductility at the time of rolling, in contrast to the prior art, with austenitic solidification and pronounced segregations.

A maximum content of 0.2% is necessary to prevent the risks of longitudinal opening of the semi-finished products, along the elongated sulfides at the time of high-temperature rolling.

A minimum phosphorous content of 0.001% is generally present in the form of manufacturing residue.

A maximum phosphorous content of 0.040% is necessary to prevent the presence of large particles of titanium phosphides formed at the time of solidification and that can impair drawing capability.

Other elements, such as cobalt, tungsten, niobium, zirconium, tantalum, hafnium, oxygen, magnesium, calcium may be present in the form of manufacturing or deoxidizing residues; other elements may be added deliberately in quantities that do not exceed 0.5% to improve specific properties such as oxidizing resistance by microaddition of yttrium, cerium, lanthanum and other rare earths.

An example of industrial use of a steel according to the invention and the properties of the final industrial product according to the invention:

On industrial production tools, a pour of 35 tons, no. 141067 was carried out with the composition according to the invention, indicated in Table 1. The operations carried out, successfully and with a low rate of defects with this pour, were as follows:

a) manufacture in air in electric furnace
b) refining in A.O.D. converter
c) continuous pouring in the form of blooms of 1 ton with square section 205×205 mm
d) hot rolling at around 1100° C. in 500 kg billets with square section of 120×120 mm
e) hot rolling of the 120×120 mm billets at around 1100° C. in coils of 500 kg with 5.5 mm wire rod
f) annealing in coils
g) pickling
h) drawing In comparison, the same operations were carried out on several pours of the grade AlSi 660, which gave rise to numerous defects (cracks on blooms, fissures on billets, flaws and scale on wire rod). Usually, the grade AlSi 660 is poured in the form of ingots without using the continuous pouring process.

As a result, this industrial test has demonstrated the superiority of the composition according to the invention for obtaining wire rods of non-oxidizing steel with high-temperature strength by an economical process including manufacturing in air, AOD refining and a continuous bloom pouring process.

In comparison to the non-oxidizing austenitic steels for high-temperature fasteners of the prior art, the alloy according to the invention presents several advantages:

a) ease in pouring, with ferritic solidification mode making it possible to pour blooms or slabs in continuous process without formation of pouring defects, central segregations, segregated wires, hot cracking; thus the need to pour in ingot followed by a supplementary blooming or stabbing operation is prevented, which is necessary for the alloys of the prior art.
b) cost-effectiveness in raw materials, especially nickel, in comparison to AlSi 660 steels currently in use.
c) ease in manufacturing; in fact, in contrast to alloys of the prior art, it is not necessary to try to obtain especially low contents of silicon, copper, sulfur, phosphorous, lead, antimony, bismuth to prevent the problems of segregation and hot fissuring and segregations; as a result, the raw material batch is simpler and more economical, and manufacturing "in air" in electric furnace and AOD, without passage through vacuum or low pressure becomes possible.
d) ease in rolling, reheating and rolling of ingots, blooms from continuous pouring and semi-finished products is possible between 1100° C. and 1200° C.; for the alloys of the prior art it is not possible, without risk of hot cracks and fissuring, to go above 1100° C. on the rough products of pouring and 1150° C. after a first rolling.

As a result, the installations dimensioned for current non-oxidizing steels can be used to roll this steel, and it is not necessary to greatly decrease the rolling speed to prevent internal fissuring by overheating at the end of the rolling.

e) resistance to oxidizing and to the environment. The alloy proposed advantageously contains a high chromium content, which insures good resistance to oxidizing and to corrosion at high temperature at the time of use, e.g. between 500° C. and 750° C. In addition, it may contain silicon, which plays the same role.

f) improved machining capability if sulfur is added, e.g. greater than 0.030%, which makes it possible to restore proper machining capability, which is the opposite of the AlSi 660 steel and the other alloys of the prior art that do not contain sulfur, since their processing at high temperature becomes impossible if the sulfur is present in significant quantity.

g) good welding capability; the alloy proposed can be welded with a very reduced tendency to high-temperature fissuring in comparison to alloys of the prior art, due to its ferritic solidification mode and the absence of large solidification segregations. In particular, it can be welded to itself using TIG or laser or by electric resistance welding, or be used as metal supply wire for MIG or TIG or in electrodes for welding.

The alloy according to the invention can be used, in particular, in the following applications:

internal furnace fittings, parts for cement furnaces, inlet or exhaust valves for automotive engines, fasteners and bolts and screws for automotive exhaust systems, springs used at high temperature, braids of wire and tubular walls for corrugated tubes for, e.g. automotive exhaust systems, wire mesh for e.g. furnace transporting mats, mechanical trapping for exhaust catalytic converters, fibers and fiber mesh for presses used for hot forming of glass, welded sheets, e.g. for turbine combustion chambers, welding support wire, machined bars, turbine synchro ring with blades fastened in variable orientation for automotive turbocompressors, sheet metal parts, annular sealing segments for automotive turbocompressors.

TABLE 1

| | Examples | | | | | | | |
|---|---|---|---|---|---|---|---|---|
| Pour/grade | 13748 | 13747 | 13605 | 13794 | 141067 | 13883 | 13822 | 13824 |
| C | 0.022 | 0.022 | 0.022 | 0.020 | 0.021 | 0.018 | 0.020 | 0.020 |
| N | 0.009 | 0.007 | 0.005 | 0.008 | 0.004 | 0.006 | 0.006 | 0.006 |
| Si | 0.251 | 0.503 | 0.454 | 0.245 | 0.186 | 0.261 | 1.300 | 0.250 |
| Mn | 0.488 | 6.233 | 0.420 | 0.342 | 1.760 | 1.795 | 4.000 | 1.700 |
| Ni | 17.13 | 17.19 | 16.26 | 17.35 | 17.34 | 17.16 | 18.20 | 18.00 |
| Cr | 19.24 | 18.57 | 19.10 | 19.14 | 19.54 | 18.57 | 18.90 | 19.00 |
| Ti | 2.078 | 2.018 | 1.950 | 2.214 | 2.074 | 2.146 | 2.150 | 2.500 |
| Mo | 1.261 | 1.262 | 1.236 | 1.240 | 1.270 | 1.244 | 0.800 | 1.250 |
| Cu | 0.201 | 0.104 | 0.100 | 0.205 | 0.064 | 0.204 | 0.200 | 0.200 |
| Al | 0.155 | 0.161 | 0.195 | 0.157 | 0.165 | 0.180 | 0.350 | 0.175 |
| B | 0.0018 | 0.0015 | 0.0013 | 0.0013 | 0.0021 | 0.0013 | 0.0012 | 0.0012 |
| V | 0.075 | 0.075 | 0.077 | 0.075 | 0.156 | 0.101 | 0.080 | 0.100 |
| S | 0.0006 | 0.0007 | 0.0022 | 0.0034 | 0.0011 | 0.0023 | 0.0005 | 0.1000 |
| P | 0.018 | 0.011 | 0.014 | 0.015 | 0.014 | 0.019 | 0.015 | 0.015 |
| eq $Cr_3$ | 28.70 | 29.22 | 28.52 | 28.96 | 29.60 | 28.74 | 30.58 | 30.18 |
| eq $Ni_a$ | 17.71 | 17.73 | 16.79 | 17.89 | 17.83 | 17.66 | 18.74 | 18.54 |
| Remainder a | 3.36 | 3.12 | 2.53 | 3.41 | 3.03 | 3.29 | 3.45 | 3.45 |
| eq $Cr_b$ | 28.61 | 27.97 | 28.44 | 28.89 | 29.25 | 28.38 | 29.78 | 29.84 |
| eq $Ni_b$ | 17.96 | 20.84 | 17.00 | 18.06 | 18.71 | 18.56 | 20.74 | 19.39 |
| Remainder b | −39.3 | −35.1 | −39.9 | −39.7 | −39.8 | −38.2 | −38.8 | −40.3 |
| value c | 21.2 | 21.0 | 21.4 | 21.1 | 21.6 | 20.6 | 21.9 | 21.0 |

| | Counter-examples | | | Compositions according to the prior art | | |
|---|---|---|---|---|---|---|
| Pour/grade | 13470 | 13606 | 13604 | 1.4980 | Nippon | Imphy |
| C | 0.017 | 0.021 | 0.021 | 0.041 | 0.004 | 0.033 |
| N | 0.006 | 0.008 | 0.011 | 0.004 | 0.006 | 0.006 |
| Si | 0.623 | 0.470 | 0.490 | 0.103 | 0.850 | 0.476 |
| Mn | 0.391 | 0.400 | 0.405 | 1.827 | 1.480 | 0.970 |
| Ni | 18.36 | 18.26 | 16.05 | 24.83 | 17.50 | 18.42 |
| Cr | 19.08 | 21.18 | 21.20 | 14.67 | 19.60 | 17.17 |
| Ti | 2.366 | 1.912 | 2.094 | 2.158 | 1.830 | 2.250 |
| Mo | 1.253 | 1.242 | 1.241 | 1.249 | 0.000 | 1.240 |
| Cu | 0.101 | 0.099 | 0.100 | 0.108 | | 0.098 |
| Al | 0.164 | 0.171 | 0.150 | 0.162 | | 0.203 |
| B | 0.0013 | 0.0014 | 0.0013 | 0.0042 | | 0.0014 |
| V | 0.073 | 0.073 | 0.075 | 0.327 | | 0.068 |
| S | 0.0017 | 0.0023 | 0.0018 | 0.0010 | | 0.0010 |
| P | 0.028 | 0.014 | 0.013 | 0.019 | | 0.009 |
| eq $Cr_3$ | 29.68 | 30.34 | 30.81 | 25.57 | 25.98 | 27.64 |
| eq $Ni_a$ | 18.78 | 18.77 | 16.56 | 25.79 | 17.59 | 19.20 |
| Remainder a | 3.94 | 3.60 | 1.16 | 13.00 | 4.60 | 5.38 |
| eq $Cr_b$ | 29.61 | 30.26 | 30.73 | 25.21 | 25.69 | 27.44 |

TABLE 1-continued

| | | | | | | |
|---|---|---|---|---|---|---|
| eq $Ni_b$, | 18.98 | 18.97 | 16.76 | 26.70 | 18.33 | 19.68 |
| Remainder b | −40.2 | −41.6 | −44.7 | −23.7 | −33.0 | −35.2 |
| value c | 21.6 | 23.5 | 23.5 | 16.8 | 20.9 | 19.5 |

TABLE 2

| | | Examples | | | | | |
|---|---|---|---|---|---|---|---|
| | Pour/grade | 13748 | 13747 | 13605 | 13794 | 141067 | 13883 |
| Solidification | micrographic observations | F | F | F | F | F | F |
| ferrite % | measurement on rough ingot (%) | 1.60 | 0.70 | 5.40 | 1.40 | 0.80 | 1.00 |
| ferrite 1240° C. | measurement on ingot processed 15 min. at 1240° C. (%) | 11.00 | 8.00 | 11.00 | 4.10 | 8.40 | 4.20 |
| burning point (° C.) | tests of high-temperature traction | 1150 | 1150 | 1180 | | | 1150 |
| ferrite 980° C. | measurement in finished state, annealed 1 h at 980° C. | 0.44 | 0.42 | | | 0.50 | 0.70 |
| ferrite 1060° C. | measurement in finished state annealed 1 h at 1060° C. | | | 2.10 | | 0.40 | |
| sigma 720° C. | measurement/finished state, processed 1 h at 980° C. + 16 h at 720° C. | 0.00 | 0.00 | | | | |
| sigma 720° C. | measurement/finished state, processed 1 h at 1060° C. + 16 h at 720° C. | | | 0.00 | | | 0.00 |
| Hardness (Hv 5 kg) | at 20° C. in aged state 16 h | 340 | 285 | 291 | | 310 | 243 |
| Rm (Mpa) | at 20° C. in aged state 16 h at 720° C. | 963 | 850 | 869 | | | |
| E0.2 (Mpa) | at 20° C. in aged state 16 h at 720° C. | 615 | 492 | 511 | | | |
| A % | at 20° C. in aged state 16 h at 720° C. | 19 | 16 | 31 | | | |
| Resilience (daJ/cm$^2$) | at 20° C. for 16 h at 720° C. + 200 h at 600° C. | | | 10.7 | | | |
| Resilience (daJ/cm$^2$) | at 20° C. for 16 h at 720° C. + 200 h at 600° C. | | | 7.7 | | | |
| Rm (Mpa) | at 20° C. for 16 h at 720° C. + 200 h at 600° C. | 1128 | 1015 | 1060 | | | |
| creep to break (h) | at 650° C. at 385 MPa for 16 h at 720° C. | 124 | | 167 | | | |
| creep to break (A %) | at 650° C. at 385 MPa for 16 h at 720° C. | 16.0 | | 7.4 | | | |

| | | Counter-examples | | | Compositions according to prior art | |
|---|---|---|---|---|---|---|
| | Pour/grade | 13470 | 13606 | 13604 | 1.4980 | Imphy |
| Solidification | micrographic observation | A + F | F + A | F | A | A |
| ferrite % | measurement on rough ingot (%) | 0.70 | 1.10 | 2.50 | | 0.40 |
| ferrite 1240° C. | measurement on ingot processed 15 min. at 1240° C. (%) | 2.04 | 11.00 | 33.00 | | 0.43 |
| burning point (° C.) | tests of high-temperature traction | 1100 | 1150 | 1140 | 1080 | 1100 |
| ferrite 980° C. | measurement in finished state, annealed 1 h at 980° C. | 0.40 | 0.50 | 0.60 | 0.00 | 0.40 |
| ferrite 1060° C. | measurement in finished state, annealed 1 h at 1060° C. | | 0.90 | 5.50 | | |
| sigma 720° C. | measurement/finished state, processed 1 h at 980° C. + 16 h at 720° C. | | | | 0.00 | |
| sigma 720° C. | measurement/finished state, processed 1 h at 1060° C. + 16 h at 720° C. | 0.00 | 4.50 | 12.00 | | 0.00 |
| Hardness (Hv 5 kg) | at 20° C. in aged state 16 h at 720° C. | 320 | 339 | 401 | 333 | 310 |
| Rm (Mpa) | at 20° C. in aged state 16 h at 720° C. | 1034 | 988 | 1019 | 1046 | 952 |
| E0.2 (Mpa) | at 20° C. in aged state 16 h at 720° C. | 650 | 663 | 765 | 699 | 589 |
| A % | at 20° C. in aged state 16 h at 720° C. | 31 | 25 | 16 | 25 | 26 |
| Resilience (daJ/cm$^2$) | at 20° C. for 16 h at 720° C. + 200 h at 600° C. | | 2.1 | | 10.9 | 10.9 |
| Resilience (daJ/cm$^2$) | at 20° C. for 16 h at 720° C. + 200 h at 600° C. | | 1.6 | | 9.1 | 9.1 |
| Rm (Mpa) | at 20° C. for 16 h at 720° C. + 200 h at 600° C. | | | | 1133 | |
| creep to break (h) | at 650° C. at 385 MPa for 16 h at 720° C. | | | | 300 | 250 |
| creep to break (A %) | at 650° C. at 385 MPa for 16 h at 720° C. | | | | 11.0 | 6.1 |

What is claimed:

1. Austenitic alloy for high-temperature strength with improved pourability and manufacturing, comprising, by weight-%:

0.010%<carbon<0.04%

0%<nitrogen<0.01% silicon<2%

16%<nickel<19.9% manganese<8%

18.1%<chromium<21%

1.8%<titanium<3% molybdenum<3% copper<3% aluminum<1.5% boron<0.01% vanadium<2% sulfur<0.2% phosphorous<0.04% and up to 0.5% of at least one element selected from the group consisting of yttrium, cerium, lanthanum and other rare earths, the remainder being iron, wherein the alloy satisfies the two following relationships:

in relationship to the solidification mode:

remainder $a$=eq. $Ni_a$−0.5×eq. $Cr_a$<3.60 where eq. $Cr_a$=Cr+0.7×Si+0.2×Mn+1.37×Mo+3×Ti+6×Al+4×V, and where eq. $Ni_a$=Ni+22×C+0.5×Cu, in relationship to the rate of residual ferrite:

remainder $b$=eq. $Ni_b$−2×eq. $Cr_b$>−41 where eq. $Cr_b$=Cr+0.7×Si+1.37×Mo+3×Ti+6×Al+4×V, and where eq. $Ni_b$=Ni+22×C+0.5×Cu+0.5×Mn.

2. Alloy according to claim 1, wherein the chromium content is greater than 18.5%.

3. Alloy according to any one of claims 1 wherein the manganese content is greater than 2%.

4. Alloy according to claim 1, wherein the silicon content is greater than 1%.

5. Alloy according to claim 1, wherein the nickel content is greater than 18%.

6. Alloy according to claim 1, wherein the aluminum content is greater than 0.3%.

7. Alloy according to claim 1, wherein the sulfur content is greater than 0.030%.

8. Alloy according to claim 1, wherein the composition alloy further satisfies the following relationship:

in relationship to the absence of formation of the embrittling sigma phase:

value $c$=Cr+1.5×Si+1.5×V+1.2 Mo<22.

9. Process for manufacturing a billet of alloy, of which the composition is according to any one of claims 1, characterized in that it includes the steps consisting of:

a) manufacturing the composition in air with electric furnace, b) refining with A.O.D. converter, c) continuous pouring in the form of blooms, d) rolling the said blooms into billets at high temperature with reheating between 1100 and 1200° C.

10. Process for manufacturing wire of alloy, of which the composition is according to any one of claims 1, characterized in that it includes the steps consisting of:

e) hot rolling after reheating, between 1100 and 1200° C., of the billets obtained by the process according to claim 9, to obtain the wire rod, f) annealing the said wire rod, g) pickling it, h) drawing or stretching it.

11. Process for manufacturing bars of alloy, of which the composition is according to any one of claims 1, characterized in that it includes the steps consisting of:

e) hot rolling, after reheating between 1100 and 1200° C., of the billets obtained by the process according to claim 9, to obtain bars, f) and annealing the said bars.

12. Alloy part that can be obtained by hot or cold machining or forming, or meshing—starting with a billet—a wire or a bar obtained by the process according to claim 9.

* * * * *